US009821485B2

(12) United States Patent
Mendenhall

(10) Patent No.: US 9,821,485 B2
(45) Date of Patent: Nov. 21, 2017

(54) ROTATING CUTTING BLADE ASSEMBLY

(71) Applicant: VANMARK EQUIPMENT, LLC, Creston, IA (US)

(72) Inventor: George A. Mendenhall, Garden City, ID (US)

( * ) Notice: Subject to any disclaimer, the term of this patent is extended or adjusted under 35 U.S.C. 154(b) by 128 days.

(21) Appl. No.: 14/917,303

(22) PCT Filed: Sep. 16, 2014

(86) PCT No.: PCT/US2014/055731
§ 371 (c)(1),
(2) Date: Mar. 8, 2016

(87) PCT Pub. No.: WO2015/039061
PCT Pub. Date: Mar. 19, 2015

(65) Prior Publication Data

US 2016/0214267 A1 Jul. 28, 2016

Related U.S. Application Data

(60) Provisional application No. 61/878,079, filed on Sep. 16, 2013.

(51) Int. Cl.
*B26D 7/06* (2006.01)
*B26D 1/12* (2006.01)
(Continued)

(52) U.S. Cl.
CPC ..... *B26D 7/0658* (2013.01); *B26D 1/0006* (2013.01); *B26D 1/12* (2013.01);
(Continued)

(58) Field of Classification Search
CPC ..... B26D 7/0658; B26D 1/36; B26D 1/0006; B26D 1/12; B26D 2001/006
(Continued)

(56) References Cited

U.S. PATENT DOCUMENTS 2,119,260 A * 5/1938 Valle ..... A21C 11/106 30/301
2,664,130 A * 12/1953 Kubon ..... B26D 1/0006 83/395
(Continued)

OTHER PUBLICATIONS

Kraft Tool Co. 30" Hex Deluxe Mud Mixer. Nov. 17, 2010 (retrieved from the internet, Dec. 8, 2014. URL: https://web.archive.org/web/20101217000946/http://krafttool.com/catalog.aspx?cat=91&subcat=117&prod=2402>.

*Primary Examiner* — Sean Michalski
(74) *Attorney, Agent, or Firm* — Jason H. Foster; Kremblas & Foster

(57) ABSTRACT

A cutting assembly for use in a hydro-cutting system in which water and food products are conveyed through tubes and the food products are sliced into smaller pieces. The cutting assembly includes multiple disks and U-shaped blades. Legs of the blades are mounted between the substantially parallel disks on opposite sides of the disks, thereby holding the blades in place. A rotationally-driven motor driveshaft extends through the assembly and the assembly is mounted in a tube. When the water and food products are conveyed into the cutting assembly, the rotating assembly slices pieces from the food product, and the pieces are separated from the water for later use or processing. The water can be used in another slicing cycle.

9 Claims, 4 Drawing Sheets

(51) Int. Cl.
*B26D 1/00* (2006.01)
*B26D 1/36* (2006.01)
*B26D 3/26* (2006.01)

(52) U.S. Cl.
CPC ..... *B26D 1/36* (2013.01); *B26D 3/26* (2013.01); *B26D 2001/006* (2013.01); *B26D 2001/0046* (2013.01)

(58) Field of Classification Search
USPC ..... 83/664, 665, 666
See application file for complete search history.

(56) References Cited

U.S. PATENT DOCUMENTS 2,884,973 A 5/1959 Crow
3,109,468 A * 11/1963 Lamb ..... B26D 3/185 83/107
3,490,504 A 1/1970 Reynolds
3,729,143 A 4/1973 Wagstaff et al.
3,796,115 A 3/1974 Dane
3,956,825 A 5/1976 Ness
4,043,036 A 8/1977 Stevens et al.
4,360,429 A 11/1982 Morris
4,372,184 A * 2/1983 Fisher ..... B26D 3/185 83/102
4,523,503 A * 6/1985 Julian ..... B26D 1/03 83/403
4,590,835 A * 5/1986 Matsuo ..... B26D 1/03 83/403
4,614,141 A * 9/1986 Mendenhall ..... B26D 7/01 83/402
4,911,045 A * 3/1990 Mendenhall ..... B26D 1/0006 83/24
5,095,875 A * 3/1992 Morris ..... B26D 1/0006 83/403
5,168,784 A 12/1992 Foster et al.
5,346,423 A 9/1994 Caveza et al.
5,362,149 A 11/1994 Nelson
5,392,758 A * 2/1995 Rognon ..... B23D 47/005 125/13.01
5,655,428 A * 8/1997 Cockburn ..... B26D 1/0006 83/402
5,687,921 A * 11/1997 Moreels ..... B02C 18/086 241/240
5,992,284 A * 11/1999 Bucks ..... B26D 1/0006 83/663
6,457,393 B1 * 10/2002 Englar ..... B26D 7/0658 83/402
6,725,765 B1 * 4/2004 Mendenhall ..... B26D 1/0006 83/402
6,805,030 B2 * 10/2004 Englar ..... B26D 7/0658 83/402
6,883,411 B2 * 4/2005 Arrasmith ..... B26D 1/02 416/187
6,952,989 B2 * 10/2005 Bucks ..... A47J 43/0705 83/177
6,955,110 B1 10/2005 Spletzer et al.
6,973,862 B2 * 12/2005 Bucks ..... B26D 7/0658 83/13
7,739,949 B2 6/2010 Justesen et al.
8,104,391 B2 * 1/2012 McCracken ..... A21C 11/10 83/331
8,109,188 B2 * 2/2012 Bellmunt-Molins B26D 1/0006 426/144
8,544,373 B2 * 10/2013 Howe ..... B23D 61/025 83/663
8,671,832 B2 * 3/2014 Beber ..... A47J 43/085 241/277
8,939,055 B2 * 1/2015 Bomont ..... B26D 1/03 83/13
D722,822 S * 2/2015 Huber ..... B26D 1/03 D7/412
9,265,381 B2 * 2/2016 Beber ..... A47J 43/046
9,517,572 B2 * 12/2016 Michel ..... B26D 7/0691
2003/0232116 A1 * 12/2003 Fein ..... B26D 1/0006 426/523
2007/0034291 A1 2/2007 Moran et al.
2007/0193429 A1 * 8/2007 Neel ..... B26D 1/0006 83/856
2008/0083312 A1 4/2008 Zschoche
2010/0236372 A1 * 9/2010 Desailly ..... B26D 1/0006 83/857
2010/0255135 A1 10/2010 Eloo et al.
2010/0282887 A1 11/2010 Walters
2013/0087032 A1 * 4/2013 Walker ..... B26D 1/28 83/402

* cited by examiner

ROTATING CUTTING BLADE ASSEMBLY

BACKGROUND OF THE INVENTION

The invention relates generally to hydraulically fed food cutting ("hydro-cutting") apparatuses, and more particularly to a rotating blade assembly used in a hydro-cutting apparatus to cut food products into a plurality of smaller pieces.

Many food products, particularly vegetables and fruits, are processed prior to sale to preserve the food so it is safe and appealing at the time of consumption. The processing can be either by canning or freezing, among others. Most food products must be sliced or otherwise shaped into an edible size prior to the preservation process unless it is an edible size before processing. Slicing and shaping operations traditionally have been accomplished with sharpened blades. Such blades can be hand-held, but hand-held knives are relatively slow and dangerous to the person using them. Other blades are machine-driven, or use machines to drive the food product into a stationary or machine-driven blade. Food cutting machines increase the speed and consistency of slicing, and provide a higher degree of safety in the food slicing industry.

Recent advances in food product cutting technologies have resulted in the hydraulically fed cutting apparatus, which is referred to by the shorthand term "hydro-cutting". Hydro-cutting involves the propulsion of water and food products, typically at very high speed, through a path that includes a stationary cutting blade. Production cutting systems and related knife fixtures are generally well known in the art of hydro-cutting vegetable products. Typical hydro-cutting systems have a so-called knife fixture that is mounted at a position along the path of the food product to slice parallel to the flow of water. Such parallel cutters usually cut or slice into strips or into a helical shape. In such a system, the food products are conveyed one-at-a-time in single file succession into the stationary cutting blades with enough kinetic energy to carry the product through the stationary knife fixture.

One disadvantage in the food products resulting from conventional hydro-cutting has been the shape of the food products after cutting. The standard "French fry" typifies the parallel cutting systems, because the resulting food products have a familiar elongated shape with a square cross-section. There is a need for a cutting apparatus that provides superior shapes, whether the superiority arises from the subsequent processing or the shape for aesthetic purposes, or both.

BRIEF SUMMARY OF THE INVENTION

In accordance with the invention, a rotatably-mounted and driven knife fixture is provided for cutting vegetable products, such as raw potatoes, into curved shapes as the vegetable products are conveyed past the knife fixture in a stream of water. The rotary knife fixture may include a blade holder and supporting housing to form concave, scoop-shaped pieces emulating cut sections of curved celery and ready for use or further processing without further cutting.

The rotary knife fixture includes a circular blade holder adapted to be rotatably driven within a vegetable product flow path such as along a hydraulic flow circuit. The blade holder includes a series of blades that are looped in a U-Shape and stacked side by side and held in place by circular inner discs. The blade fixture is placed in a modified cutter head housing that has been designed to gently feed the product downstream into the rotating cutting blade. After the food product has been cut, its smaller pieces are carried downstream by the surrounding water and separated on a conveyer. The blade holder has been designed to be easily removed for replacing blades with alternate configurations or with fresh sharp blades.

Figure 1:
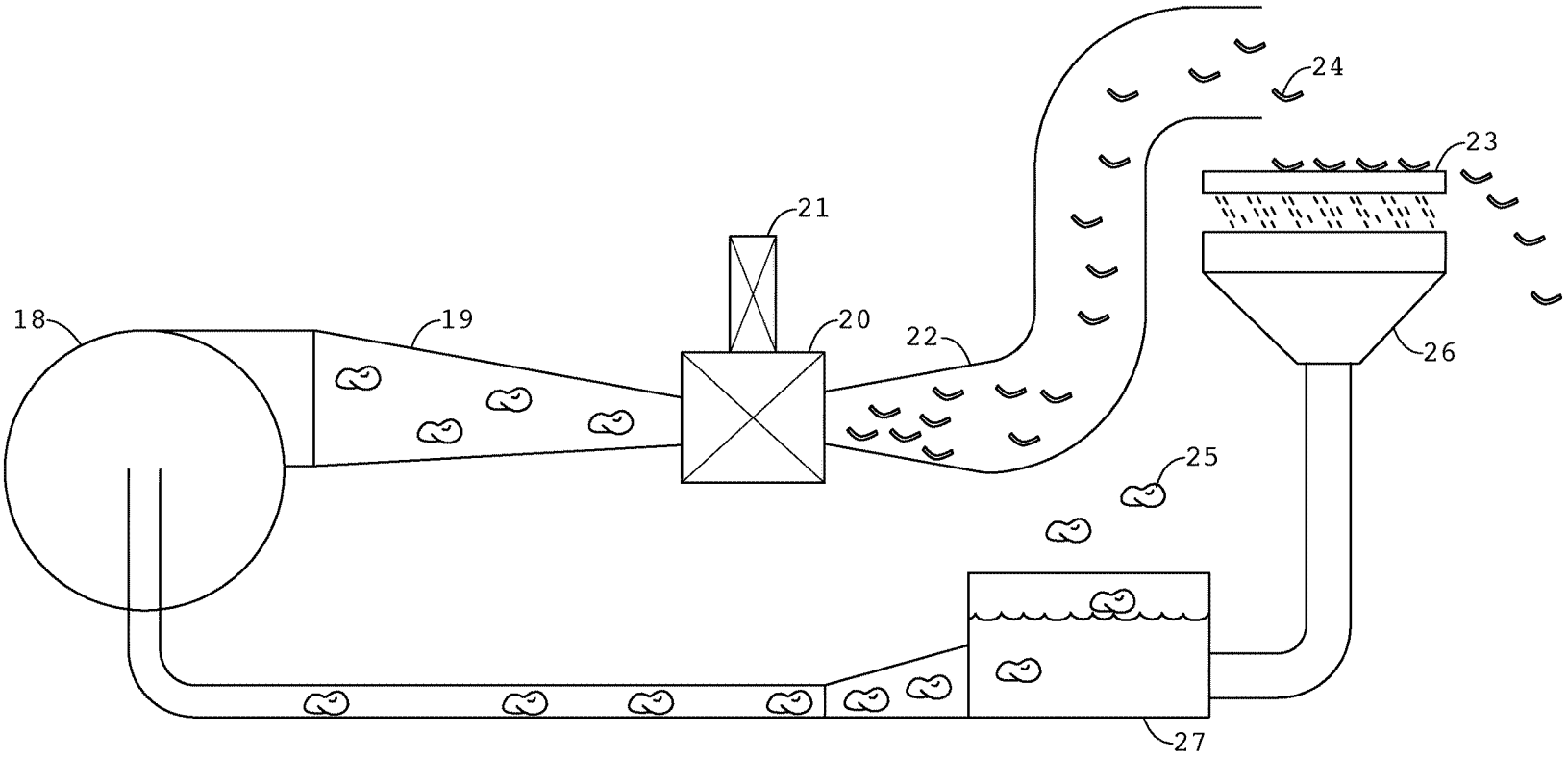
FIG. 1 is a schematic side view illustrating a hydraulic cutting system including a rotatably-driven knife assembly constructed in accordance with the present invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

The apparatus for cutting food products according to a first embodiment of the invention is shown in an operable configuration with various other components of a hydro-cutting apparatus in FIG. 1. One or more pieces of a food product 25, such as a potato or any other food product that would work with the apparatus described herein, are placed in a container 27. The container 27 also contains water that is pumped, along with the products 25, through a series of tubular conduits by a pump 18. The pump 18 forces the combination of water and products 25 through a decreasing cross-section conduit 19 that accelerates the water and the products 25 to a maximum velocity just as they pass through a cutting region 20, which is preferably a modified cutter head housing. Downstream of the cutting region 20 is an increasing cross-section conduit 22 that receives the water and the pieces 24 and decreases the velocity of the same prior to conveying the water and pieces 24 onto a preferably straining conveyor 23 that carries the pieces 24 to another step in the process. Water passes through the straining conveyor 23 into the conduit 26 that guides the water, after possibly filtering it, into the container 27 to repeat the cycle.

Figure 2:
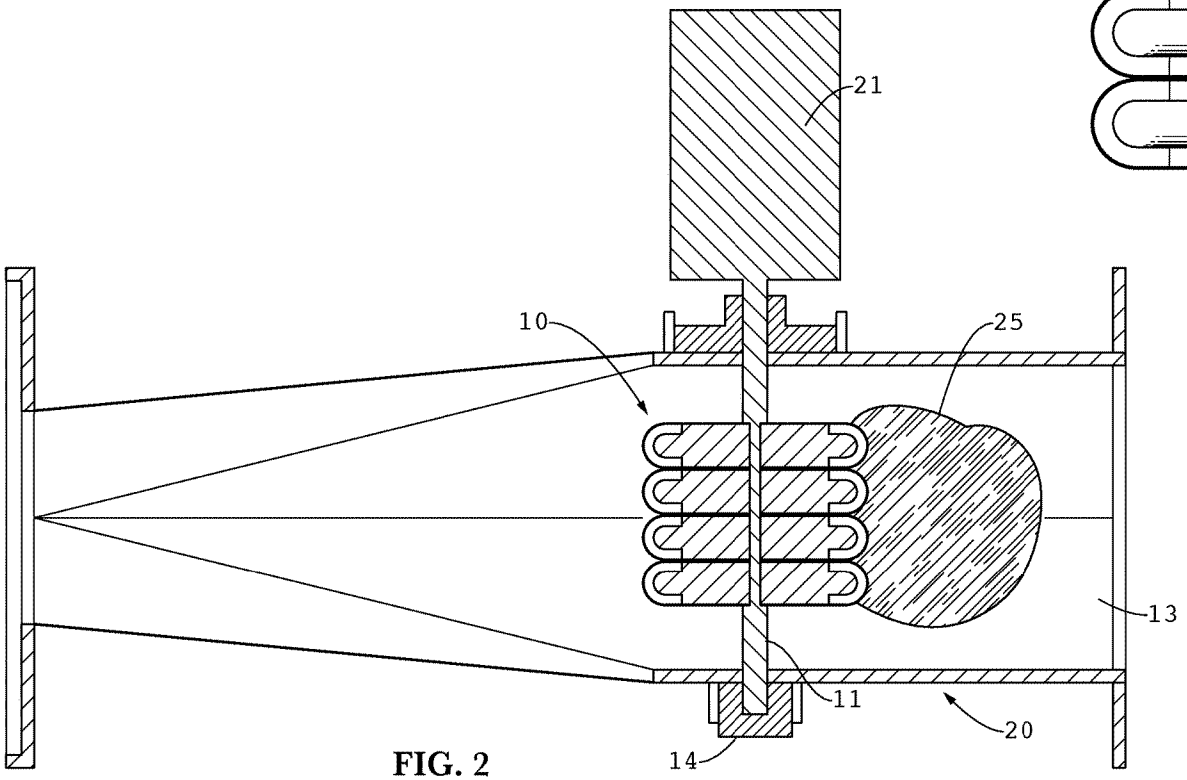
FIG. 2 is an enlarged side view in section illustrating a rotary motor mounted to a driveshaft to which the cutting assembly is mounted to rotate perpendicular to the flow of water through the cutter head housing.

The cutting region 20 houses an assembly 10 for cutting the products 25 into the pieces 24 as described above. The assembly 10 is shown in FIG. 2 mounted to the driveshaft 11 of a rotary prime mover, which may be an electric motor 21 or any similar rotating drive mechanism, including without limitation a hydraulic motor or a pneumatic motor. The motor 21 may be rigidly mounted to the sidewalls of the housing that defines the cutting region 20, with the driveshaft 11 extending through the passage 13 defined by the sidewalls to a bearing 14 on the opposite side from the motor 21. Seals are provided at the insertion of the driveshaft to avoid leaking of the water. The assembly 10 is rotatably mounted in the cutting region 20 through which water and food products 25 are conveyed so that as food products 25 are conveyed through the cutting region, they are sliced.

Figure 3:
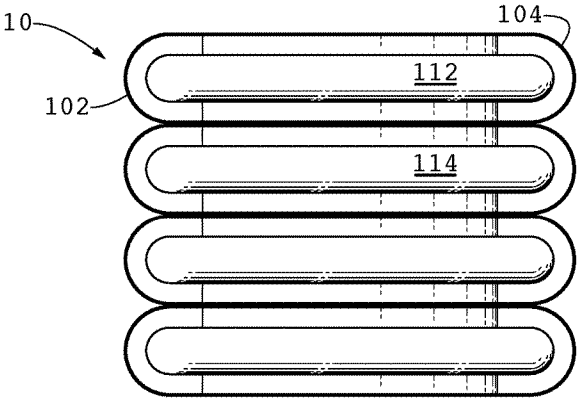
FIG. 3 is a side view illustrating the cutting assembly of FIG. 2.

The assembly 10 is shown in more detail in FIG. 3. The assembly 10 may have one or more blades mounted to one or more plates that are aligned along the driveshaft 11. In one embodiment the plates are the disks 112 and 114, which are circular, coaxially aligned and mounted to one another by the driveshaft 11 (not shown in FIG. 3) extending through apertures in the disks 112 and 114. The disks can be made of any food-grade material, including stainless steel, plastic, ceramic, or any other suitable material. The blades 102 and 104 are U-shaped structures having one leg on one side of the disk 112. The leg extends along a radial line extending from about the center of the disk 112 toward and beyond the peripheral edge of the disk 112. The blade 102 extends along a curved arc around the peripheral edge of the disk 112, and spaced from the peripheral edge of the disk 112, and continues with a second leg extending on the opposite side of the disk 112. The second leg extends along a radial line of the disk 112 that is on the opposite axial side of the disk 112 from the first leg. The blade 104 is substantially identical to the blade 102 and is positioned similarly, as shown, on the opposite edge of the disk 112. The disks have peripheral surfaces that cooperate with, and are spaced from, the blades 102 and 104, as described below.

Although two blades are shown positioned at 180 degree spacing (along a diameter of the circular disk 112), three or more blades can be mounted to each disk. It is also contemplated to use only one blade on each disk. Three blades may be evenly spaced around the periphery of each disk, for example at every 120 degrees, rather than every 180 degrees as in the embodiment of FIG. 4 that has two blades per disk. Of course, four, five, six or more blades can be mounted around each disk with the angles between each blade being substantially equal, as determined by the number of blades. Thus each blade on a disk is identical, and is evenly spaced around the disk relative to every other blade, and spaced radially the same distance from the axis of the disk. However, it is contemplated to make each blade slightly different to gain cutting advantages. Furthermore, the blades in such alternatives may be spaced at varied angles from adjacent blades around the disk. Still further, each blade in such alternative may extend a slightly different radial distance from the axis, for example to cut progressively thicker pieces, thinner pieces, varied pieces or in case the rotating speed of the assembly can thereby be increased. The blades 102 and 104 can be made of any material that can be sharpened sufficiently, and maintain a sharpened condition for a sufficient number of cuts through food products, and includes at least stainless steel, tool steel, and ceramic materials.

Figure 5:
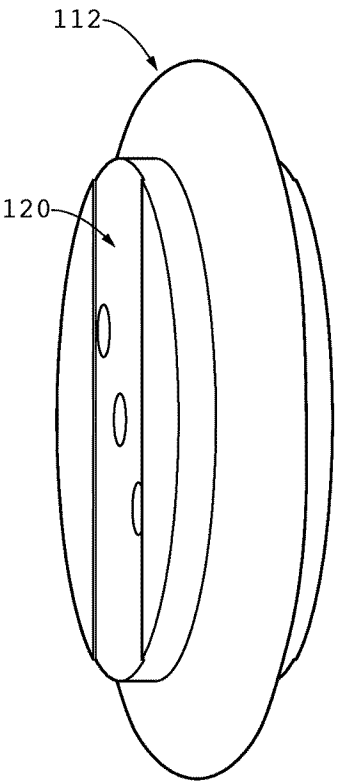
FIG. 5 is a side view in perspective illustrating a disk used in the cutting assembly.
Figure 4:
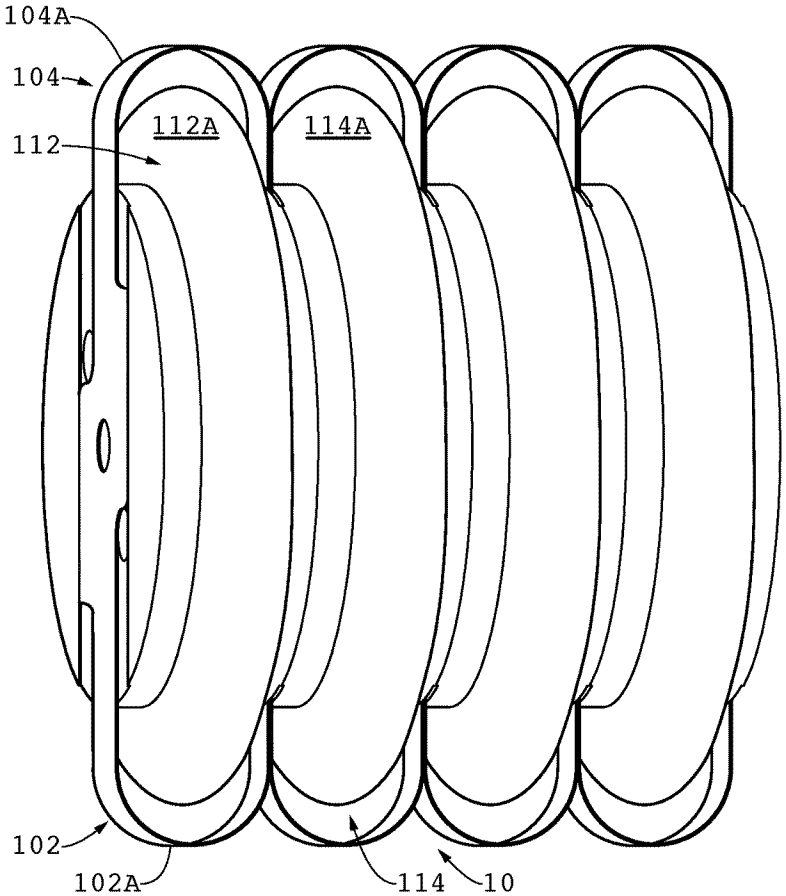
FIG. 4 is a side view in perspective illustrating the cutting assembly of FIG. 2.

In the embodiment of the assembly 10 shown in FIGS. 3 and 4, the blades 102 and 104 extend as a first leg on one side of the disk 112 to a second leg on the opposite side of the disk 112, where the second leg of each blade is sandwiched between the disk 112 and the disk 114. When the disks 112 and 114 are clamped together, with at least one shaft extending through the aligned holes formed through the disk 112 and the blades 102 and 104, the arcuate, sharpened portions 102*a* and 104*a* of the blades are positively located and rigidly held at a position a predetermined distance from the peripheral edge of the disk 112. In one embodiment, the disk 112 has a groove 120 (see FIG. 5) formed on one side and a similar groove formed on the opposite side (that aligns with and faces the groove 124 on the adjacent disk 114). Thus, upon rotation of the disks 112 and 114, the sharpened, arcuate portions 102*a* and 104*a* of the blades 102 and 104 rotate around the same axis of rotation and remain the same distance from the peripheral surface of the disk 112. This provides a cutting action into any food product 25 that comes within the paths of the portions 102*a* or 104*a*.

Figure 6:
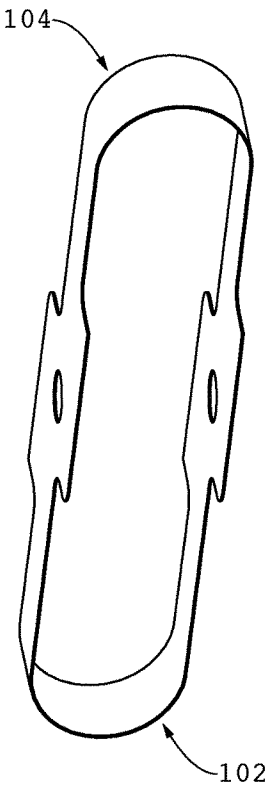
FIG. 6 is a side view in perspective illustrating a blade used in the cutting assembly.

FIG. 6 shows the blades 102 and 104 separated from the disk 112 for illustrative purposes. The blades are not contemplated for use apart from the disks. As noted above, any feasible number of similar (or different) blades and disks can be mounted together to form a cutting assembly that can be positioned in a passage, through which water and food products are conveyed, and then is driven in rotary motion. The food products can be conveyed through the cutting region 20 at a speed that is less than the speed at which conventional hydro-cutting takes place, and that speed can be about one-third the speed of conventional hydro-cutting, although this is not critical. It will become apparent to the person of ordinary skill from the disclosure herein that one, two, three, four, five or more blades can be mounted to a similar or dissimilar number of disks or other plate-shaped structure and the combination can be driven in rotary motion when mounted in the cutting region of a hydro-cutting apparatus. The number of disks can be increased to whatever the space will allow. The blades can mount around disks like those shown and described herein, or any alternative plates that are sufficient to operate as the disk and blade combination described herein.

Upon rotation of the cutting assembly 10 in the cutting region 20, any food products 25 that are conveyed into the cutting assembly 10 first contact the sharp leading edge of one of the blades or the curved peripheral edges 112*a* or 114*a* of the disks 112 and 114 (between the blades 102 and 104). The location of impact will depend upon the location of the blades in their rotational movement relative to the food product as the food product approaches the assembly 10. If the first impact is on the curved peripheral edges 112*a* or 114*a*, the assembly will continue rotating with the food product in contact therewith until the leading sharp edge of the next blade comes into contact with the food product.

Once the sharp edge of the first blade comes into contact with the food product, the sharp edge of the blade will readily pass through the food product and exit the opposite side thereof, forming a U-shaped cut through the food product that severs a food piece 24 from the remainder of the food product 25. Once this occurs, the piece 24 severed from the food product 25 is free to move away from the large portion of the food product 25 that remains. Because the assembly 10 is rotating rapidly and the water forces the food products 25 against the assembly 10, for every blade on the assembly a piece 24 is formed once during every rotation of the assembly 10. Thus, for the embodiment shown in FIGS. 3 and 4, eight pieces 24 are formed for every rotation of the assembly 10, assuming the food product is in contact with all blades.

The water flowing around the pieces 24 preferably dislodges and removes the pieces 24 severed from the remaining portion of the larger food product 25. The pieces 24 move away to create space for the food product 25 to continue moving toward the assembly 10 (as the water forces the food product 25 downstream accordingly) while the next blade rotates further to make contact with the food product 25. The impact of the next blade repeats the cutting cycle by forming another slice in the food product very similar to the previous slice. Each cutting movement of each blade frees another piece 24 to be removed from the large food product by the action of the water. This cutting and flowing action proceeds in series as the water drives the food products against the assembly 10, and allows the cutting blades to remove series of pieces from the large food product until the food product is fully sliced into pieces 24. These pieces 24 flow downstream from the cutting region 20 to the conveyor 23 where they are separated from the water, which is re-used after possibly being filtered. The separated pieces are preferably conveyed to be processed further, or to containers.

As noted above, the peripheral surfaces 112*a* and 114*a* are shaped in a complementary fashion. As the food product 25 moves toward the assembly 10 after pieces have been removed therefrom, the shape of the outer surface of the food product 25 is determined by the shape of the outer surface of the sharpened blade portions 102*a* and 104*a*. The peripheral surfaces 112*a* and 114*a* of the disks accept the blade-shaped outer surface of the food product 25 so that when the next cut is made by the blades, the food product pieces have the same, or very similar, shape as the previous pieces. These pieces have a shape that is determined by the shape of the opening between the peripheral surfaces 112*a* and 114*a* and the blades 102 and 104. By making the peripheral surfaces 112*a* and 114*a* similar to the shape of the cut surfaces of the food product 25, the pieces 24 are shaped desirably.

Figure 8:
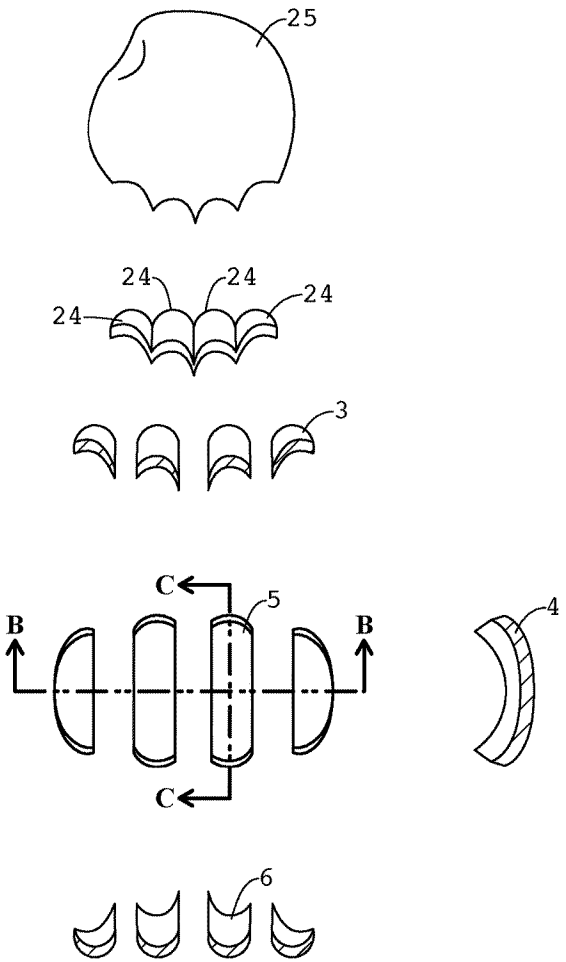
FIG. 8 is a schematic illustrating the different stages of product during the slicing process.
Figure 7:
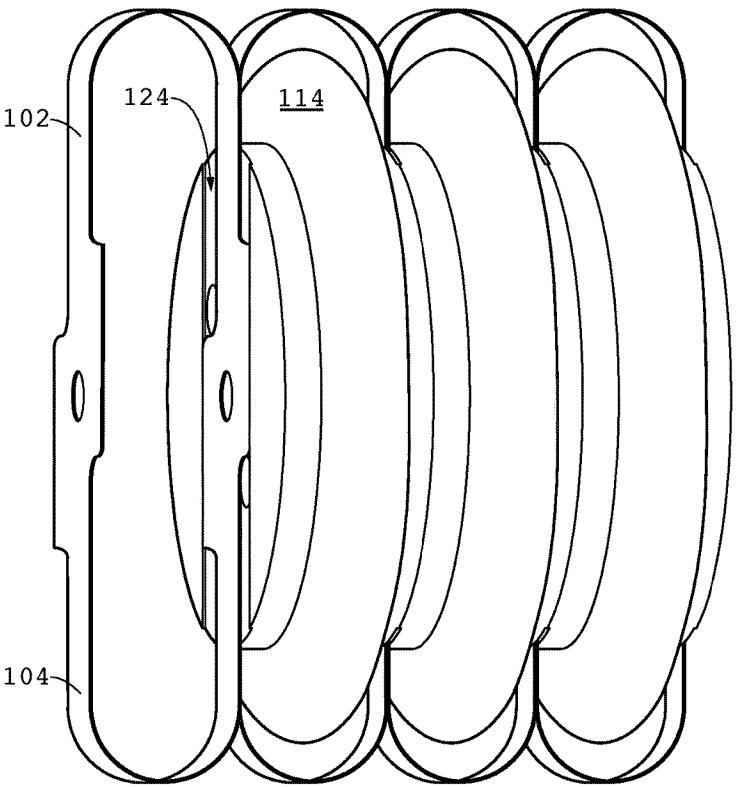
FIG. 7 is a side view in perspective illustrating the cutting assembly of FIG. 2 with one of the disks removed to illustrate the position of both blades of the removed disk.

As illustrated in the schematic of FIG. 8, the food product 25 is cut into pieces 24. Each piece 24 can be substantially the same, or it can vary in shape and size according to the position of the food product 25 relative to the assembly 10. As shown in FIG. 8, the substantially spherical food product 25 has four pieces 24 removed from it by one pass of the blades of the assembly 10. These food products are adjacent one another, but are shown separately in the lower portion of FIG. 8 (adjacent reference numeral 3). Adjacent reference numeral 5, the pieces 24 are shown from the side that faces the assembly 10 during cutting. At reference numeral 4, a piece 24 is shown when viewed through the line C-C, and it can be seen that the piece 24 is curved along its longest axis, as well as along it shortest. That is, due to the arcuate cutting path of the blades of the rotating assembly 10, the pieces 24 are arcuately-shaped along their length. Furthermore, because the blades of the assembly 10 have arcuate sharpened portions 102*a* and 104*a*, the pieces 24 are arcuately-shaped along their width. This is further illustrated in FIG. 8 at reference numeral 6, which shows the pieces 24 through the line B-B having an arcuate shape.

The shape of the pieces can be modified by modifying the shapes of the blades used on the assembly, such as to square, v-shaped or even irregular, along with the shape of the disks' peripheral edge, in order to provide a desired shape. Such alternative shapes will become apparent to the person of ordinary skill from the description herein.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A cutting assembly configured for rotational motion in a path of flowing water and food products to slice the food product into smaller pieces, the cutting assembly comprising:

(a) at least a first plate and a second plate, the plates mounted substantially parallel to, and adjacent, one another to form a space between facing surfaces of the plates and a plurality of openings aligned through said at least two plates through which a driveshaft is configured to extend; and (b) at least a first blade having a first leg extending through the space, the first blade extending radially outwardly around a peripheral edge of the first plate and having a second leg extending radially inwardly toward the driveshaft on an opposite side of the first plate.

2. The cutting assembly in accordance with claim 1, further comprising at least a second blade having a first leg extending through the space, the second blade extending radially outwardly around a peripheral edge of the second plate and having a second leg extending radially inwardly toward the driveshaft on an opposite side of the second plate.

3. The cutting assembly in accordance with claim 2, further comprising:

(a) a third blade having a first leg extending through the space, the third blade extending radially outwardly around a peripheral edge of the first plate spaced from the first blade, the third blade having a second leg extending radially inwardly toward the driveshaft on an opposite side of the first plate from the third blade's first leg; and (b) a fourth blade having a first leg extending through the space, the fourth blade extending radially outwardly around a peripheral edge of the second plate spaced from the second blade, the fourth blade having a second leg extending radially inwardly toward the driveshaft on an opposite side of the second plate from the fourth blade's first leg.

4. The cutting assembly in accordance with claim 3, wherein the first and third blades are positioned at substantially opposite peripheral edges of the first plate, and the second and fourth blades are positioned at substantially opposite peripheral edges of the second plate.

5. A cutting apparatus for slicing food products that are conveyed through a conduit with water by a pump, the apparatus comprising:

(a) a cutting assembly rotatably mounted in the conduit, the cutting assembly including at least a first plate, a second plate and a first blade;

(b) wherein the first and second plates are mounted substantially parallel to, and adjacent, one another to form a space between facing surfaces of the plates;

(c) a driveshaft extending from a rotational-driving motor through at least said first and second plates; and (d) wherein the first blade has a first leg extending through the space, and the first blade extends radially outwardly around a peripheral edge of the first plate and has a second leg extending radially inwardly toward the driveshaft on an opposite side of the first plate.

6. The cutting apparatus in accordance with claim 5, wherein the cutting assembly further comprises at least a second blade having a first leg extending through the space, the second blade extending radially outwardly around a peripheral edge of the second plate and having a second leg extending radially inwardly toward the driveshaft on an opposite side of the second plate.

7. The cutting apparatus in accordance with claim 6, wherein the cutting assembly further comprises:

(a) a third blade having a first leg extending through the space, the third blade extending radially outwardly around a peripheral edge of the first plate spaced from the first blade, the third blade having a second leg extending radially inwardly toward the driveshaft on an opposite side of the first plate from the third blade's first leg; and (b) a fourth blade having a first leg extending through the space, the fourth blade extending radially outwardly around a peripheral edge of the second plate spaced from the second blade, the fourth blade having a second leg extending radially inwardly toward the driveshaft on an opposite side of the second plate from the fourth blade's first leg.

8. The cutting apparatus in accordance with claim 7, wherein the first and third blades are positioned at substantially opposite peripheral edges of the first plate, and the second and fourth blades are positioned at substantially opposite peripheral edges of the second plate.

9. A method of slicing food products that are conveyed with water through a conduit by a pump, the method comprising:

(a) mounting a cutting assembly in the conduit, wherein the cutting assembly includes at least:

(i) a first plate and a second plate mounted substantially parallel to, and adjacent, one another to form a space between facing surfaces of the plates;

(iv) a first blade having a first leg mounted in the space, the first blade extending radially outwardly around a peripheral edge of the first plate and extending a second leg of the first blade radially inwardly on an opposite side of the first plate;

(b) extending a driveshaft from a rotational-driving motor through at least said first and second plates;

(c) conveying water and food products through the conduit; and (d) rotating the cutting assembly by engaging the rotational-driving motor.

* * * * *